US005746125A

United States Patent [19]

Tani

[11] Patent Number: 5,746,125

[45] Date of Patent: May 5, 1998

[54] ENCLOSED MULTI-BLADE SQUEEGEE STRUCTURE FOR SCREEN PRINTING

[75] Inventor: Okie Tani, Tokyo, Japan

[73] Assignee: Tani Electronics Industry Co., Ltd., Tokyo, Japan

[21] Appl. No.: 611,812

[22] Filed: Mar. 6, 1996

[30] Foreign Application Priority Data

Aug. 31, 1995 [JP] Japan ..... 7-259183

[51] Int. Cl.[6] ..... B41L 13/18

[52] U.S. Cl. ..... 101/123; 101/120

[58] Field of Search ..... 101/120, 119, 101/123, 126, 129

[56] References Cited

U.S. PATENT DOCUMENTS

| | | | |
|---|---|---|---|
| 3,805,699 | 4/1974 | Mallofre | 101/123 |
| 3,885,493 | 5/1975 | Jaffa | 101/123 |
| 3,969,999 | 7/1976 | Zimmer et al. | 101/120 |
| 5,287,806 | 2/1994 | Nanzai | 101/123 |
| 5,452,655 | 9/1995 | Tani | 101/123 |
| 5,476,039 | 12/1995 | Hiruta et al. | 101/123 |
| 5,483,879 | 1/1996 | Tani et al. | 101/123 |

FOREIGN PATENT DOCUMENTS

| | | |
|---|---|---|
| 316947 | 5/1989 | European Pat. Off. . |
| 0 626 259 | 11/1994 | European Pat. Off. . |
| 964 769 | 12/1956 | Germany . |
| 1-019275 | 4/1989 | Japan . |
| 6-210829 | 8/1994 | Japan . |
| 07032581 | 2/1995 | Japan . |
| 2202795 | 10/1988 | United Kingdom . |
| 2242164 | 9/1991 | United Kingdom . |

*Primary Examiner*—Ren Yan
*Attorney, Agent, or Firm*—Foley & Lardner

[57] ABSTRACT

A multi-blade screen printing arrangement provides a control mechanism for positoning of squeegees for effecting variable width screen printing with interchangeable squeegee blades. Further, a comprehensive printing material processing portion includes various arrangements for carrying out agitation of a printing material within a cylindrical chamber which may be readily mounted within the control mechanism. Further, the movable squeegee control and the suspended housing of the control mechanism allow for continuous adjustment of printing pressure, resetting of printing operations and flow control according to a desired printing thickness.

7 Claims, 13 Drawing Sheets

ENCLOSED MULTI-BLADE SQUEEGEE STRUCTURE FOR SCREEN PRINTING

BACKGROUND OF THE INVENTION

1. Field of the Invention

The present invention relates to screen printing. Specifically the present invention relates to a squegee blade assembly structure for enclosed squegee type screen printing which is optimized for various printing modes (i.e. variable width printing, etc.) encounted in screen printing of solder, etching compounds, or the like, utilized in the manufacture of electronic components (i.e. printed circuits, etc.).

2. Description of the Related Art

For printing electric circuit patterns on an insulating base board, a so-called "screen printing" has been hitherto used. The printing system employed in this printing comprises generally a screen (or mesh) plate which is put on an insulating base board to be printed, and a squeegee (viz., ink squeezing device) which runs on the screen plate while squeezing a given amount of viscous conductive compound, such as solder or conductive ink, etc., onto the screen plate and pressing the screen plate against the insulating base board. With this, a desired circuit pattern of the conductive ink is printed on the surface of the insulating base board, which pattern coincides with a perforated print pattern defined by the screen plate. The base board thus printed is then removed from the screen plate and heated for fixing the printed circuit pattern. The screen plate is constructed of a stainless steel mesh or the like.

A screen printing plate and a mask plate are used for applying such a conducitive compound on a circuit substrate. Squeege arrangements commonly employed for such operations include an open type and and an enclosed type which includes a housing portion.

Such conventional screen printing devices as described above have been disclosed for example, in Japanese Patent Application First printing No. 19275/1989.

However, according to such conventional screen printing arrangement, there remain drawbacks.

For example, according to the requirements of modern manufactured electronic components, a circuit density is quite high. That is very thin connective lines of the circuit pattern which must be printed by the screen printing apparatus reliably, preferably at high speed and low cost.

Mainly, in such enclosed type printing apparatus, printing is carried out by supplying a printing material to a chamber having the mesh screen at a lower side thereof under pressure. The material is there agitated and kneaded to maintain sufficient viscosity of the material which is supplied to and excess retrieved from a squeegee opening. The temperature of such a printing chamber is controlled and sealed with an inert gas.

However, effecting printing of circuits by such an enclosed squeegee apparatus is difficult since a required pitch for such circuit type screen printing apparatus may be extremely fine and with a high density of printed lines. Because of the high density and fine pitch required of modern printed circuits, and other factors such as providing a high density conductive plating having a fine pitch width remain to be solved.

In addition, since a desired circuit pattern of the conductive ink is printed on the surface of the insulating base board, which pattern coincides with a perforated print pattern defined by the screen plate. The base board thus printed is then removed from the screen plate and heated for fixing the printed circuit pattern. The screen plate is constructed of a stainless steel mesh or the like.

For improving the quality of the printed pattern on the base board, it is necessary to clean the screen plate at certain intervals. Hitherto, various cleaning devices have been proposed and put into practical use for such purpose. However, due to their inherent construction, a satisfactory cleaning effect is difficult to obtain and also such clean apparatus tend to be costly.

Also, in such screen printing processes for printing of circuits etc., a screen printing plate and a mask plate are used for applying the printing material onto the substrate according to the predetermined image pattern. Such screen printing plates are commonly of the metal type or alternatively the mesh type. A squeegee device frequently used are the above mentioned, enclosed or open type squeegee assemblies.

The present invention further relates to a squeegee blade for effecting such screen printing operations according to the method of the invention.

Since fine-pitch narrow patters are requested for printing, the size of a grain of a printing material becomes finer. Therefore, it is difficult to print narrow patters owing to diversification of pattern surfaces, substrate material, and printing material. It also becomes difficult to stably and continuously print mixed patterns consisting of narrow and wide patterns.

When using a metal squeegee blade on a mesh screen or a very thin metal screen, the following problems are commonly encountered; 1) damage to a main surface of the printing plate at front and rear ends thereof inflicted by movement of the squeegee blades extending in a transverse direction to a printing direction across the width of the screen plate; 2) imperfections caused by residual printing material left on the screen plate after printing due to the low viscosity of some of the printing material used in such screen printing operations (i.e. solder or the like); 3) unevenness of printing pressure at concave portions of a printing screen, or when so-called 'half pitch' screen printing plates are utilized having more than one depth of pattern formed thereon to be printed; 4) residual printing material remaining on a printed article or conversely, printed areas of the article having the printing material removed therefrom by passage of a squeegee blade, particularly with fine pitch printed areas; 5) abrasion of the squeegee blade material particularly if the printing material utilized is very hard, thus it becomes difficult to assure consistency of printing results and further, problems occur in terms of energy saving, frequency of blade replacement, and stable production speed and quality; and 6) arriving at a suitable structure for a squeegee blade according to operations when a printed surface of a single article requires that mixed wide, narrow, large and small patterns be printed.

Thus, it has been required in the art to provide a reliable, simple and compact structure for carrying out variable width screen printing for circuit patterns.

Further, it is required that the substantially heavy printing materials utilized in such circuit printing be sutiably agitated to maintain proper viscosity therof. Providing a compact assembly for screen printing in which reliable agitating means and control mechanisms are enclosed has also been required in the art.

In addition the structure of such an enclosed multi-blade squeegee structure must assure a functional relation between a printing material agitiating portion and a squeegee blade portion is reliable, compact and substantially simple in structure for assuring long-term continous screen printing operation may be carried out.

SUMMARY OF THE INVENTION

It is therefore an object of the present invention to provide a screen cleaning device for use in the screen printing, which is free of the drawbacks of the related art.

It is further an object of the invention to provide a method of screen printing and apparatus therefor which can effect reliable and high speed circuit printing in which cleaning operation is reliably assured.

According to still another aspect of the invention, there is provided a compact assembly for screen printing in which reliable agitating means and control mechanisms are enclosed.

According to a first aspect of the present invention, there is provided an enclosed multiblade squeegee arrangement for screen printing comprising: a housing portion having a printing material supplying chamber provided therein; a replacable squeegee having a predetermined width; a squeege control portion for movably controlling the squeegee for effecting printing operation; and retaining means for mounting a squeegee blade, a width of the retaining means being adjustable for accommodating a selected one of the interchangeable squeegees.

According to another aspect of the invention there is provided a printing material agitating apparatus for an enclosed squeegee type screen printing device for printed circuits, comprising: a cylindrical printing material processing chamber; a movable shaft disposed substantially along an axial center of the printing material processing chamber; a plurality of agitating members attached to the movable shaft; and drive means for moving the movable shaft for effecting agitation of printing material in the chamber.

In addition, according to a still further aspect of the invention there is disclosed a paired blade squeegee arrangement for an enclosed squeegee type screen printing device for printed circuits, comprising: a front blade being disposed foremost in a predetermined printing direction; a rear blade disposed behind the front blade relative the printing direction and aligned substantially in -parallel therewith; the front and rear blades being vertically movable for adjusting a printing pressure and communicated with a printing material outlet portion of a printing material processing chamber of a printing apparatus.

BRIEF DESCRIPTION OF THE DRAWINGS

The objects and advantages of the present invention will be apparent from the following description taken in conjunction with the accompanying drawings. In the Drawings.

DESCRIPTION OF THE PREFERRED EMBODIMENT

Hereinbelow, a preferred embodiment of the invention will be explained in detail with reference to the drawings. Referring to FIGS. 1–14, the enclosed squeegee structure according to the invention is formed as a compact cylindrical unit formed of of resilient metallic plate, for example. The unit is closed by left and right side plate and is formed with an upper intake port for receiving painting material (i.e. solder paste) and a lower outlet port for providing the printing material to a printing portion, such as a squeegee blade, in a controlled manner so as to effect circuit printing.

Further, the stucture of the invention may selectively supply printing material to a plurality of different squeegee blade portions to effect variable width screen printing. Also, temperature control means and printing material agitating means for maintaining a desired viscosity of printing material are provided.

Paired squeegee blades are rotatably driven in a direction corresponding to a printing direction to oppose a contact surface of a screen plate with controlled amounts of printing material being supplied thereto for effecting clean and accurate printing with simple structure. A blade thickness t according to the present embodiment is selected to be approximately 0.1 mm to 0.2 mm for a fine print blade and approximately 1 mm to 3 mm for a thick print blade thereof.

Figure 1:
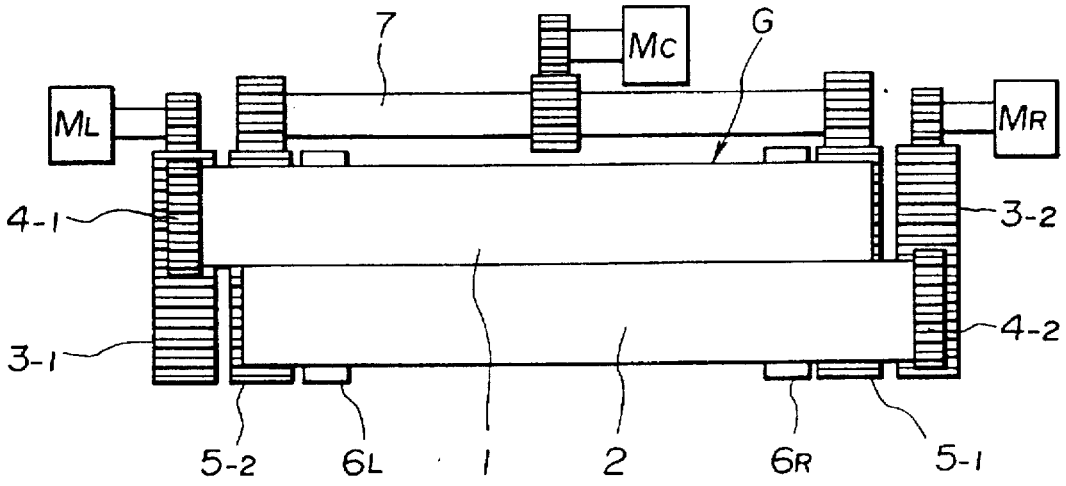
FIG. 1 is a schematic illustration of a printing material processing mechanism according to a preferred embodiment of the present invention.
Figure 11:
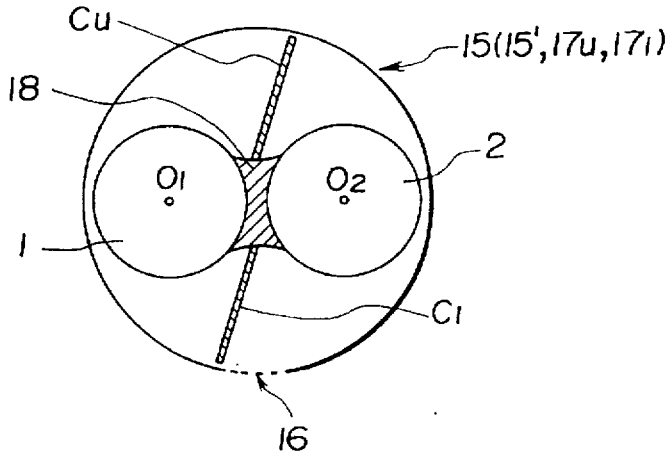
FIG. 11 is a cross-sectional side view of an interior structure of the printing material process portion.

FIG. 1 shows a lateral cross section of the enclosed squeegee screen printing unit according to a first preferred embodiment of the invention facing in a printing direction therof. Cylindrical rotation members 1, 2 are disposed in opposing positions and connected for co-rotation around a common axis, as best seen in FIG. 11. the cylindrical rotation members 1, 2 are positioned having longitudinal axes thereof in parallel to the cylindrical housing of the unit. As will be noted from FIG. 11, a gap of approximately 1 mm is determined between an outer surface of each of the cylindrical rotation members 1, 2 and an inner surface of the cylindrical housing 15 of the unit. Internal gears 3-1, 3-2, 4-1,4-2 transmit rotational driving force to the cylindrical rotation members 1, 2. Rotational gears 5-1, 5-2 are connected with identical side plate members 6L, 6R for controlling coaxial rotation of same. A gear shaft 7 receives rotational energy from the driving source Mc such as an electric motor for example, and transmit the driving force to the rotational gears 5-1, 5-2. Further, additional left and right driving souces MR ML are provided for independently providing driving force to the internal gears 3-1, 3-2, 4-1, 4-2.

Figure 2:
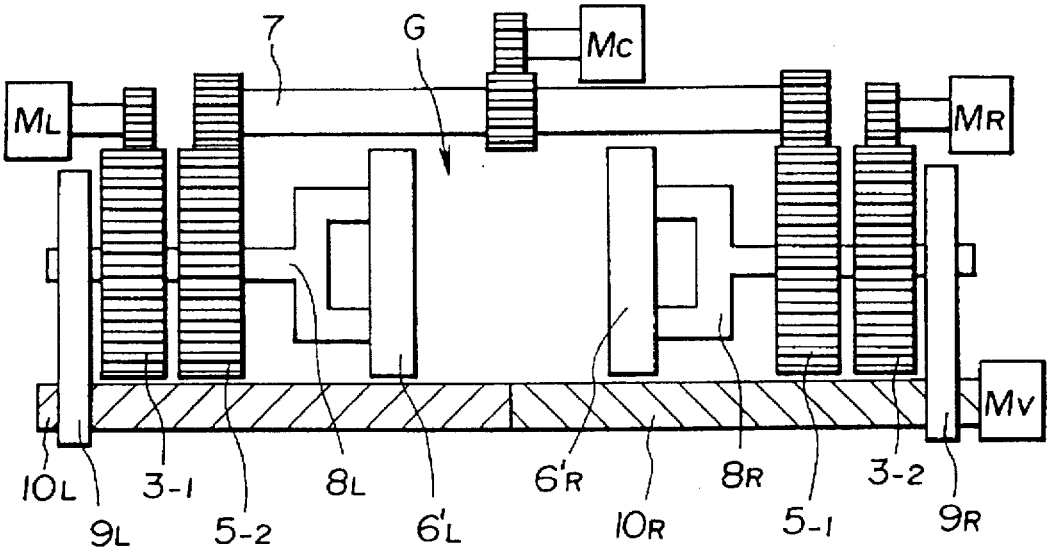
FIG. 2 is a schematic view of essential portions of the of a screen printing device according to the invention.

FIG. 2 shows alateral cross section of an alternative embodiment of an enclosed squeegee screen printing unit according to the invention. In this modification, the cylindrical rotation members 1, 2 (not shown) are disposed in opposing positions and connected for co-rotation around a common axis positioned having longitudinal axes thereof in parallel to the cylindrical housing of the unit and a gap of approximately 1 mm is determined between an outer surface of each of the cylindrical rotation members 1, 2 and an inner surface of the cylindrical housing 15 of the unit as with the previous embodiment. Also, internal gears 3-1, 3-2, 4-1,4-2 transmit rotational driving force to the cylindrical rotation members 1, 2. Rotational gears 5-1, 5-2 are connected with identical side plate members 6'L, 6'R for controlling coaxial rotation of same. A gear shaft 7 receives rotational energy from the driving source Mc such as an electric motor for example, and transmits the driving force to the rotational gears 5-1, 5-2. Further, additional left and right driving souces MR ML are provided for independently providing driving force to the internal gears 3-1, 3-2, 4-1, 4-2. In addition, chuck portions 8L, 8R which are connected between the side plate members 6L, 6R and a driving plates 9L, 9R engaged with driving screws 10L, 10R which are respectively driven by a driving power source Mv.

Figure 3:
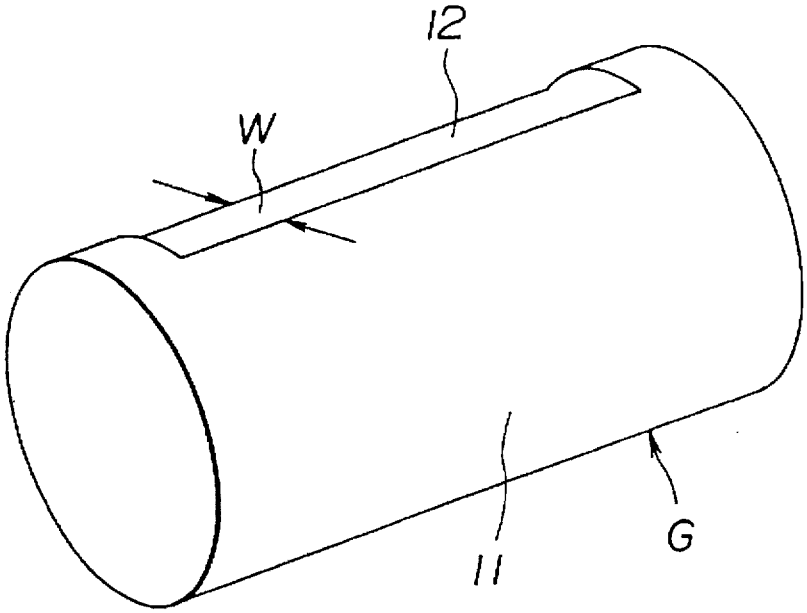
FIG. 3 is a perspective view of a printing material processing portion which may be utilized in the mechanism of FIGS. 1 and 2.
Figure 4:
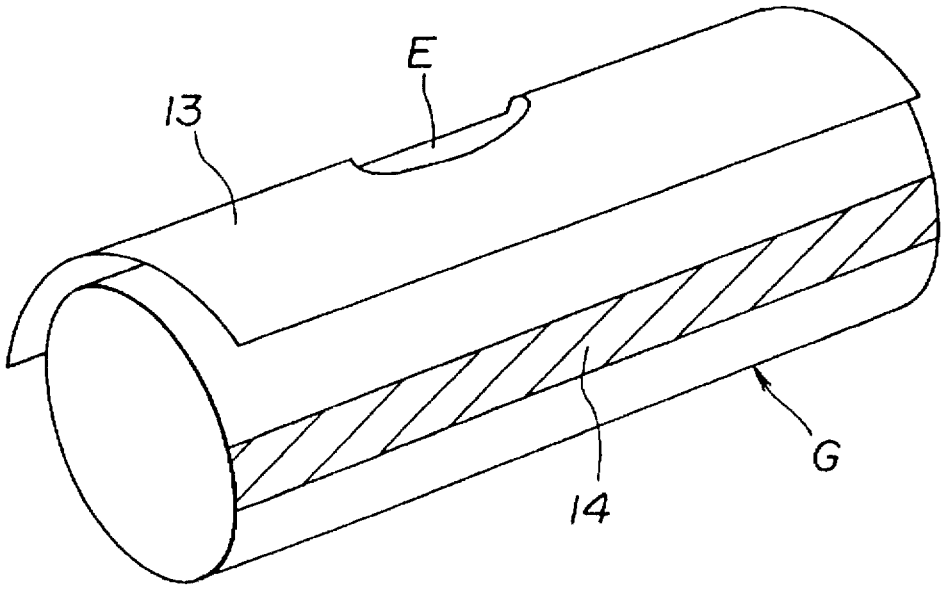
FIG. 4 shows an alternative construciton of a printing material processing mechanism according to the invention.

In a printing material processing portion G of the second embodiment, a cylindrical printing material processing portion 11 having a slit formed therein with a width w as shown in FIG. 3 is provided. An upper side of the printing material processing portion 11 has a guard plate 13, (FIG. 4) formed of resilient metallic plate or the like, disposed thereover with a printing material intake port E defined therethrough. The upper guard plate 13 does not rotate according to operation of the enclosed squeegee screen printing unit. A side plate 14 is provided at each side of the printing material processing portion 11.

Figure 5:
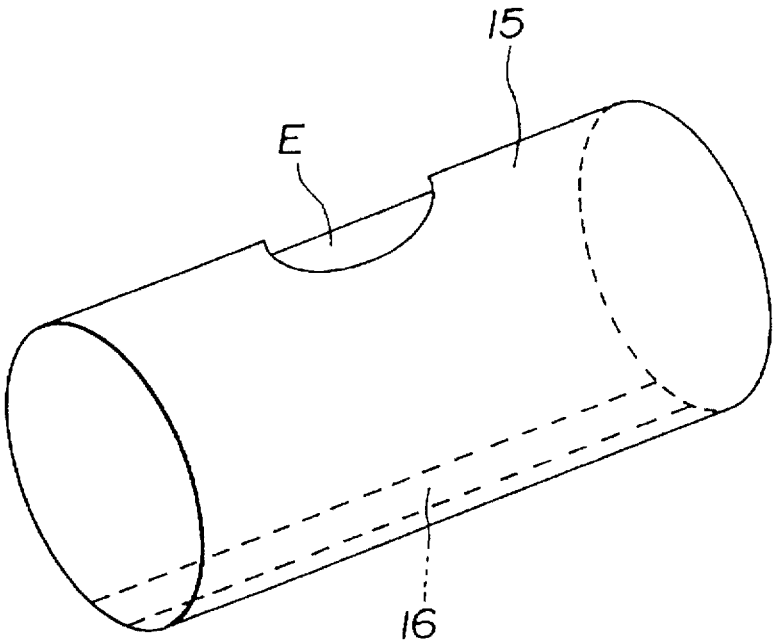
FIG. 5 shows another alternative construciton of a printing material processing mechanism according to the invention.

FIG. 5 shows a contstruction of a printing material processing portion 15 including upper printing material inlet port 13 and lower printing material outlet port 16 defined thereon.

Figure 6:
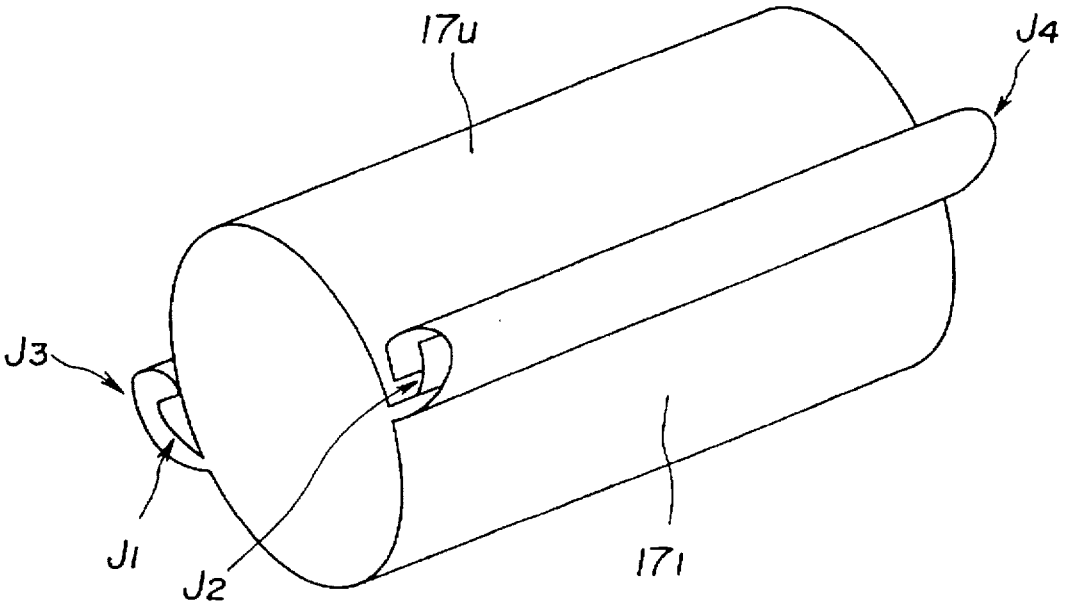
FIG. 6 shows a fourth alternative construciton of a printing material processing mechanism according to the invention.
Figure 7:
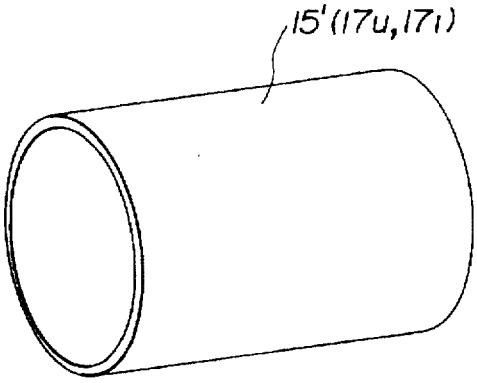
FIG. 7 shows a fifth alternative construciton of a printing material processing mechanism according to the invention.

Referring now to FIGS. 6 and 7, perspective views of further alternative configurations of the printing material processing portion are shown. FIG. 6 shows a cylindrical printing material processing portion 17 comprising upper and lower portions 17u, 17l respectively provided with interlocking portions J1, J2 of the upper portion 17u and J3, J4 of the lower portion 171. In FIG. 7 a metallic single piece cylinder 15' is shown.

Figure 8:
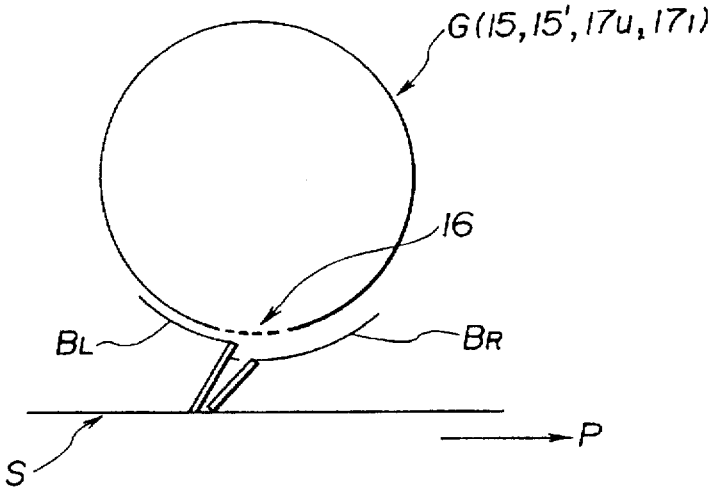
FIG. 8 shows a paired squeegee arrangement mounted relative the printing material processing portion of the invention.
Figure 9:
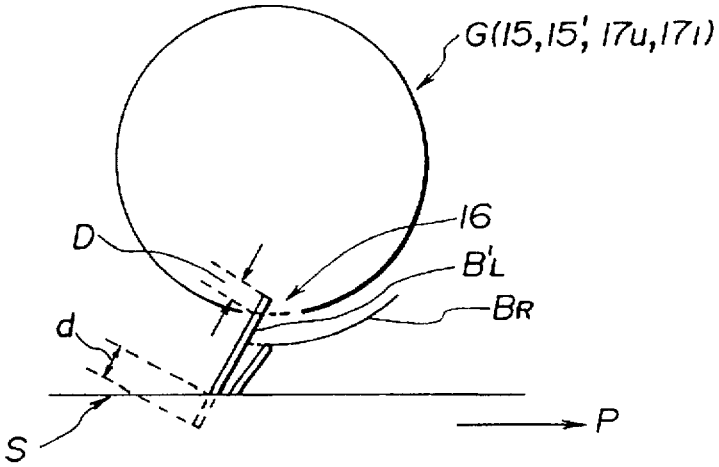
FIG. 9 shows another embodiment of a paired squeegee arrangement mounted relative the printing material processing portion of the invention.
Figure 10:
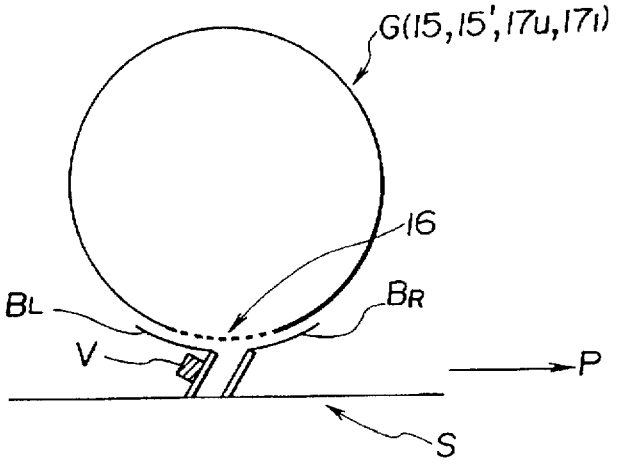
FIG. 10 shows yet another embodiment of a paired squeegee arrangement mounted relative the printing material processing portion of the invention.

Referring now to FIGS. 8–10 the relation between the cylindrical printing material processing portions G described hereinabove (15, 17u, 17l) and squeegee blade portions of the arrangement according to the invnetion are shown.

As may be seen in the drawings the invention provides a paired blade arrangment wherein each squeegee blade B is disposed at a predetermined angular position to contact a printing surface of a screen plate S and moved in a printing direction P according to printing operation. The blades, denoted respectively as left and right blades Bl, Br (or B'l, B'r) are supplied with printing material via the printing material outlet port 16 from the processing portion G. According to the present structure, the front blade relative to the printing direction Bl, is vertically displaceable by distances D, d according to a distance from the screen plate. An upper side of the blade Bl being retracted to a positon within the printing material supply opening 16. According to clockwise rotation of the cylindrical rotation members 1, 2 distribution of printing material from the printing material processing portion G smooth supply of printing material is assured.

FIG. 10 shows an arrangment of the blades BL, BR having uniform profiles and further inlcudes a blade length adjustment means V associated with at least one of the paired blades BL, BR.

FIG. 11 shows a cross-sectional view of the printing material processing portion G including the cylindrical rotation members 1, 2 and a connecting member 18 for joining the cylindrical rotaion members 1, 2 for co-rotation.

Figure 12:
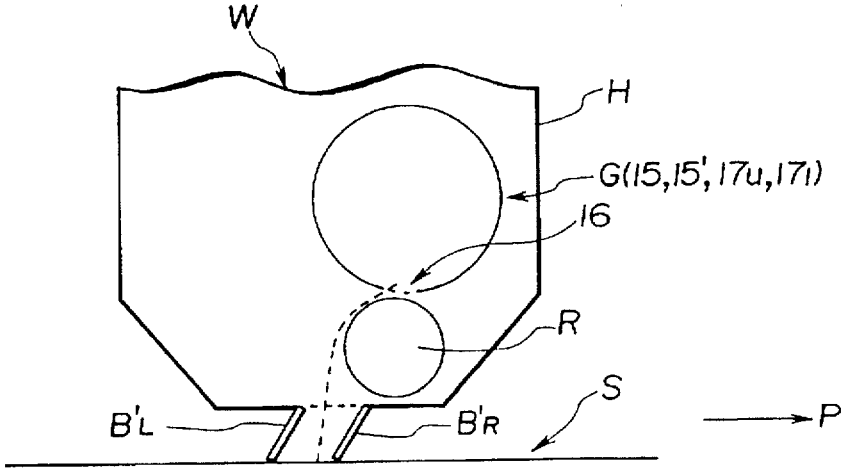
FIG. 12 shows a configuration of the paired squeegee blade structure and the printing material processing portion as mounted in an enclosed multi-blade squeegee structure.

Referring now to FIG. 12, a configuration of an enclosed multi-blade squeegee structure for screen printing is shown having an enclosed housing H and a roller unit R interposed between the printing material outlet port 16 of the printing material processing portion G (15, 17) and the blades B'L, B'R. An upper portion W of the housing H interfaces the assembly with a screen printing apparatus (not shown).

Figure 13:
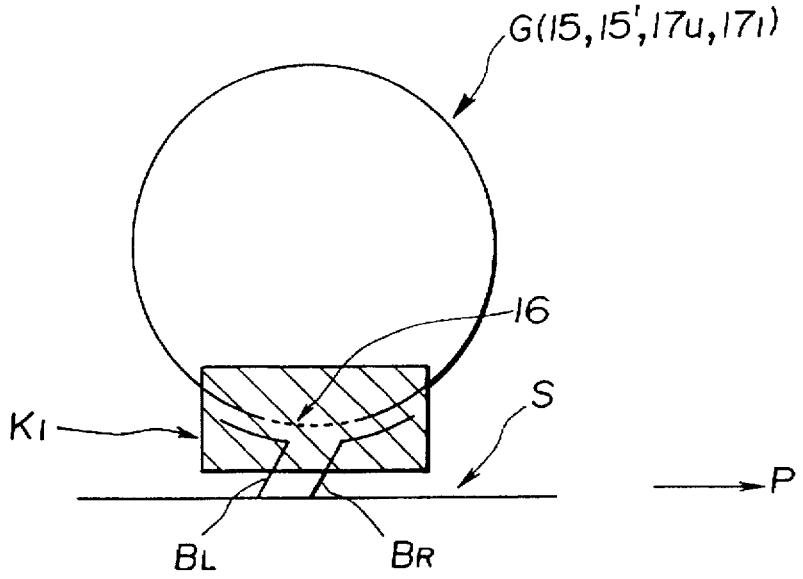
FIG. 13 is a schematic side view of a configuration of the printing material processing portion and squeegee blade structure including driving power sources according to another embodiment of the invention.
Figure 14:
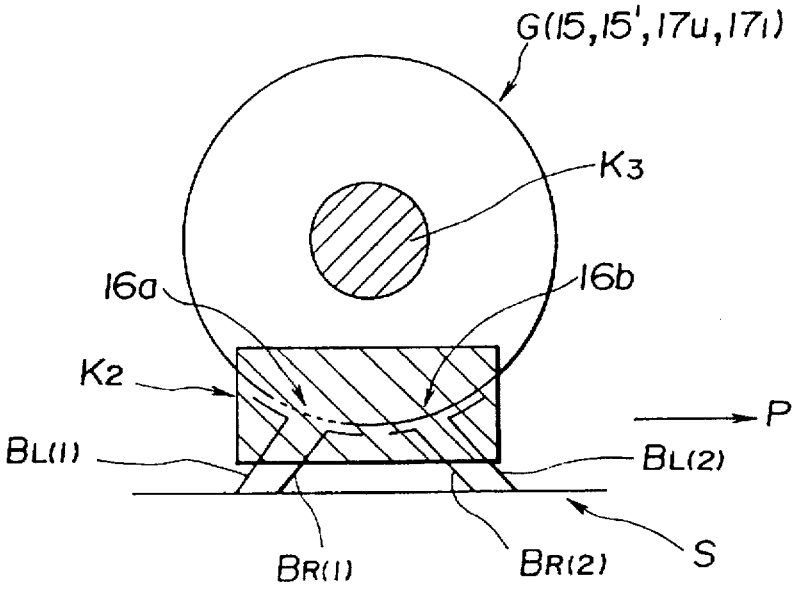
FIG. 14 is a schematic side view of another configuration of the printing material processing portion and squeegee blade structure including driving power sources according to another embodiment of the invention.

FIGS. 13 and 14 show the apparatus of the invention according to further alternative embodiments thereof. The shaded area K1, K2 and K3 of the drawings indicate driving power units attached at a side of the printing material processing portion G (15, 17) for effecting control of squeegee movement. As may be seen in FIG. 14, a two sets of paired squeegee blades BL, BR (1), BL, BR (2) are provided in conjunction with two printing material outlet ports 16*a*, 16*b*. The sets BL, BR (1) and BL, BR (2) of the squeegee blades according to the present embodiment are disposed at different angular positions toward and opposing the printing direction P. the driving power unit K3 of FIG. 14 may be implemented for driving the cylindrical rotation members 1, 2 for agitation of the printing material and the driving power units K1, K2 are active for squeegee control. As may be seen the power unit K2 may act to raise and lower a forward or rearward pair of the squeegee blades BL, BR (1), BL, BR (2) according to a particular printing operation.

Now, referring to FIGS. 15–19, a control mechanism for operation of an enclosed multiblade squeegee structure for screen printing according to the invention will be described in detail hereinbelow. According to the control mechanism of the invention, variable width screen printing is preferrably enabled.

Figure 15:
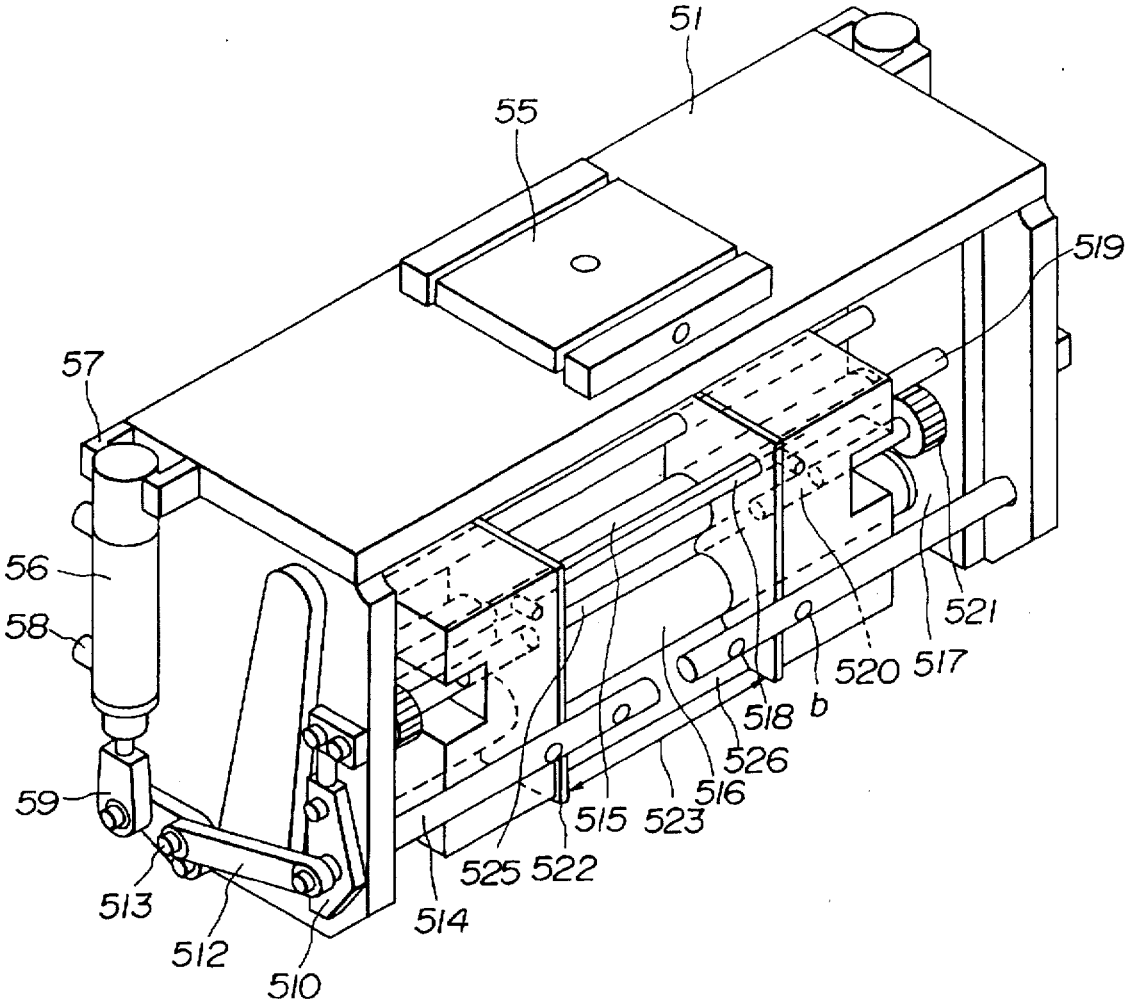
FIG. 15 is a perspective view showing an embodiment of a control mechanism structure for an enclosed multi-blade squeegee arrangement according to the invention.

As may be seen in FIG. 15, the control mechanism according to the invention includes a top lid portion 51, outer wall portions 52 (see FIG. 18), an outer wall support bar 53 (see FIG. 19 (C)) and a suspension portion 55 integrated with the top lid portion 51 for mounting the control mechanism within a screen printing apparatus (not shown). According to mounting of the control mechanism via the suspension portion the assembly may be moved vertically and horizontally in up, down, forward and rearward directions.

Figure 16:
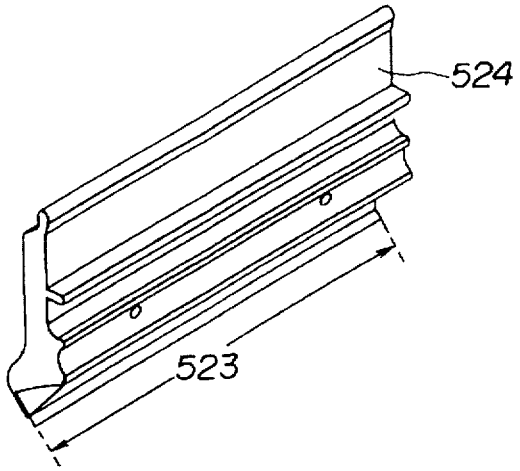
FIG. 16 shows a squeegee structure utilized in screen printing operation.

Further, an outside plate 54 (see FIG. 18) forms an outer body of the control mechanism and is formed so as to protrude from the bottom of the outside wall portion 52. FIG. 16 shows a perspective view of a movable squeegee 524 including a printing blade 523. A mechanism for driving the movable squeegee is provided on the surface of the outside plate portion 54 and as may be seen in FIG. 15 an air cylinder 56 is provided on an outer side of the ouside wall portion 52 which is utilized as a driving power source for controlling blade opening and closing operations. The air cylinder 56 is retained by a cylinder holder 57 and is supplied with compressed air, or other suitable gas, by a supply line 58. An adjusting rod 59 of the air cylinder 56 is connected with a slow-motion adjusting unit 510 via a driving rod 512 and a connector 513. A driving shaft 514 for controlling motion of the movable squeegee 524 and may be moved to front or rear sides of the control mechanism by operation of the above described components.

The rotational direction, speed and rotational frequency of roller portion 515, 516 are controlled by a motor, or the like (not shown). As may be seen the FIG. 15, the roller portions are rotatably mounted within the housing of the control mechanism.

Figure 17A:
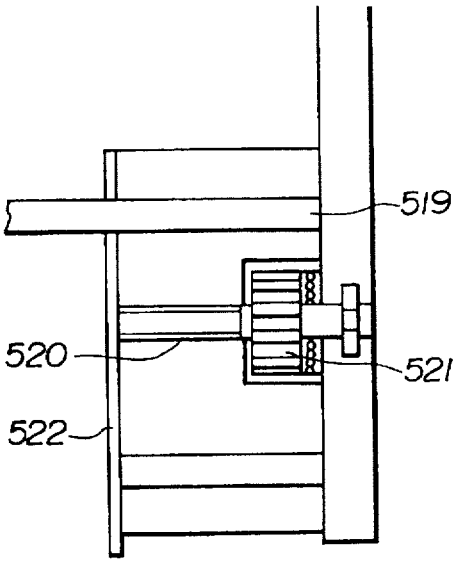
FIGS. 17 A and B are schematic views of an essential portion of the control mechanism of FIG. 15.
Figure 17B:
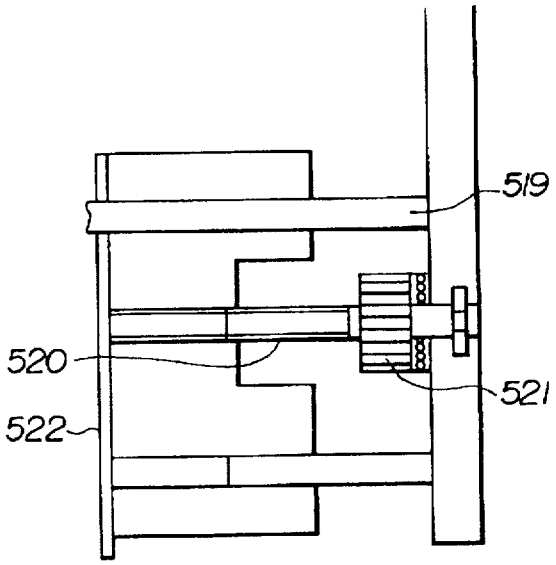

FIGS. 17(A) and 17(B) show a mechanism for effecting width adjustment control according to the invention. According to this an inside plate 517 of the control mechanism. The inside plate 517 is associated with a driving guide 518 (FIG. 15) a guide support portion 519 and a driving screw 520, a squeegee width adjusting gear 521 and an inner plate 522 to set a predetermined printing material supply width via the squeegee width adjusting gear 521 according to a width of the squeegee blade 523.

The squeegee 524 is set within the width established according to the squeegee blade 523 and is controlled by the inside plate and a support portion (not shown). a portion below the lower roller 516 and the inside plate 522 includes a wall blade 525 and a fixed blade 526 for setting a chamber 527. Printing is accomplished by supplying a printing material to the chamber 527.

Figure 18:
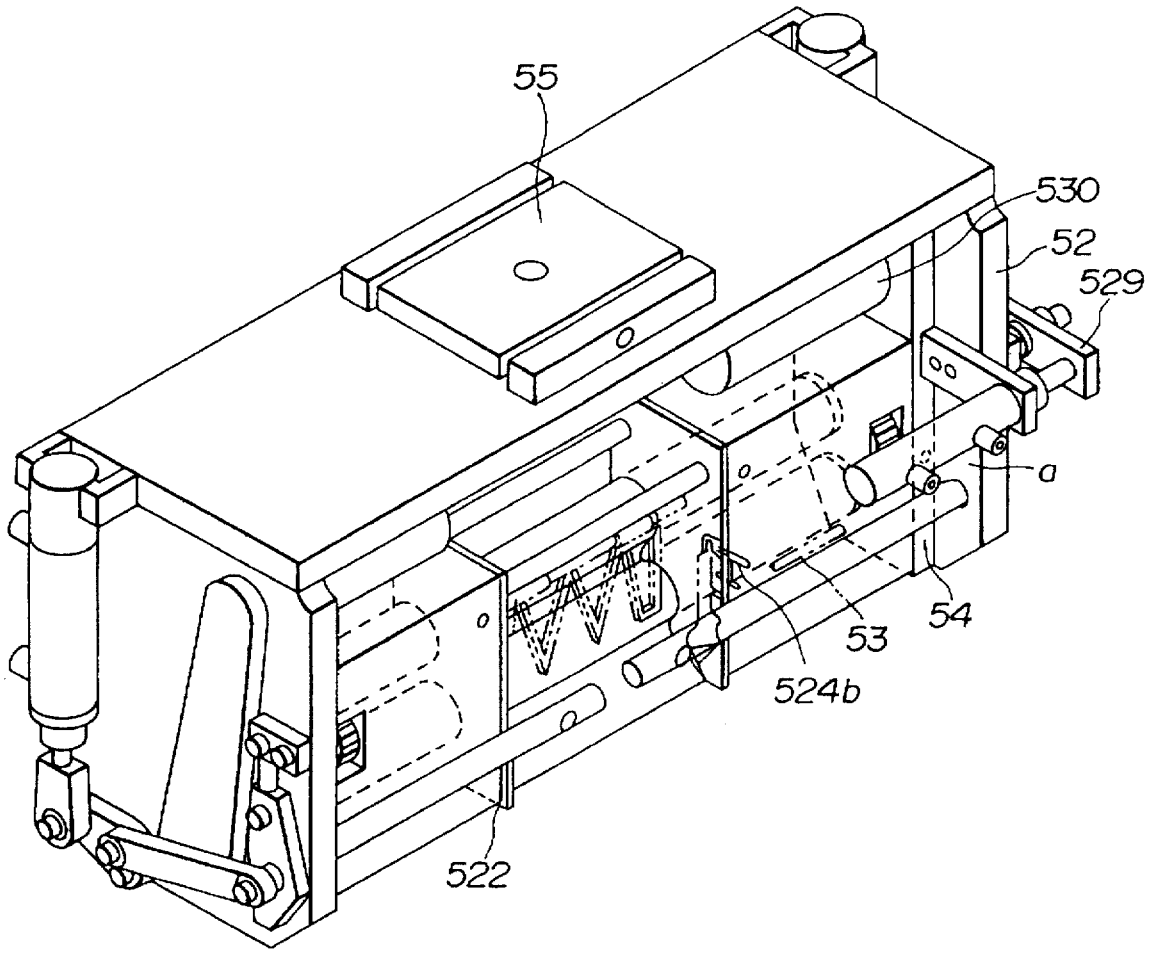
FIG. 18 is a perspective view showing an embodiment of a control mechanism structure for an enclosed multi-blade squeegee arrangement according to the invention.
Figure 19A:
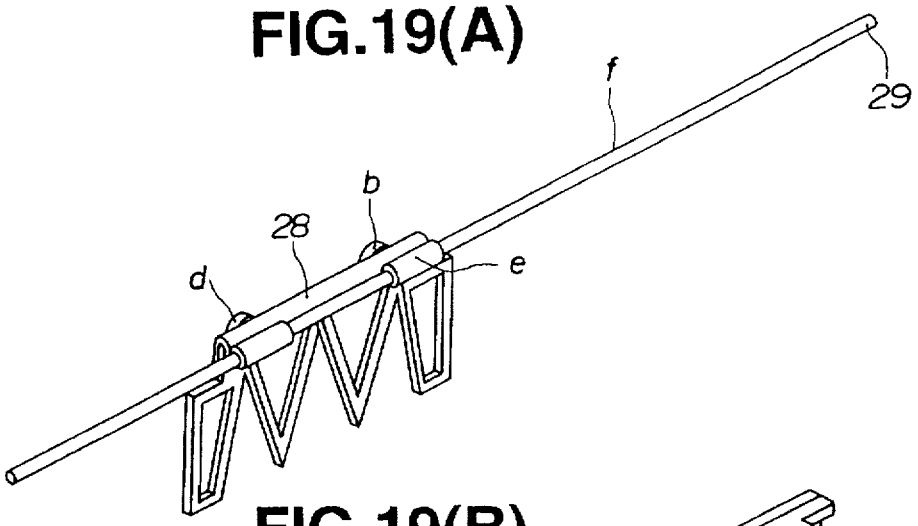
FIGS. 19 A, 19 B and 19 C show enlarged perspective view of componets of a squeegee mounting and control portion of the control mechanism of FIGS. 15 and 18.
Figure 19B:
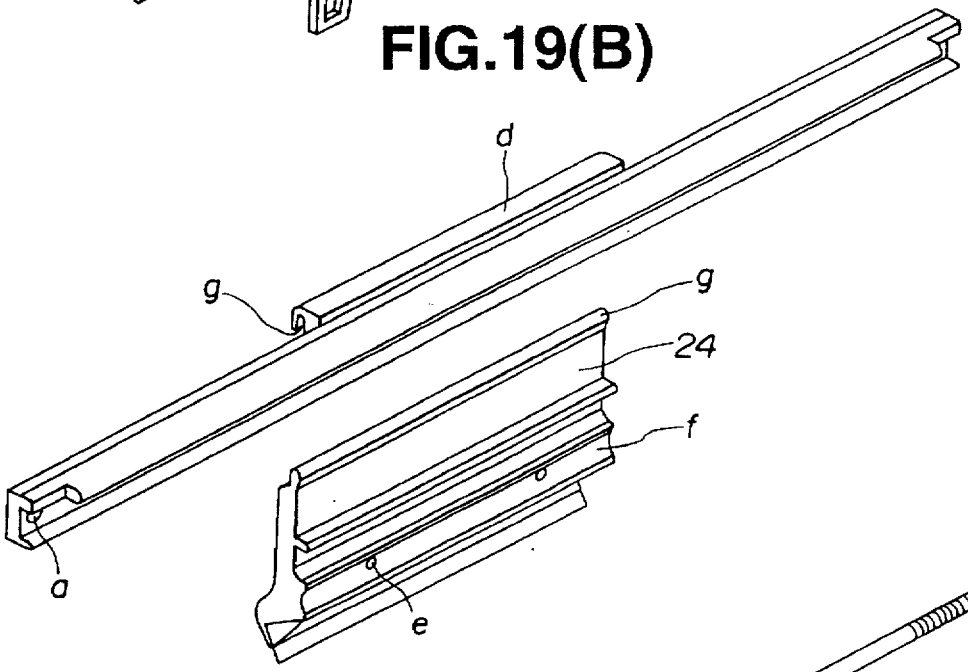
Figure 19C:
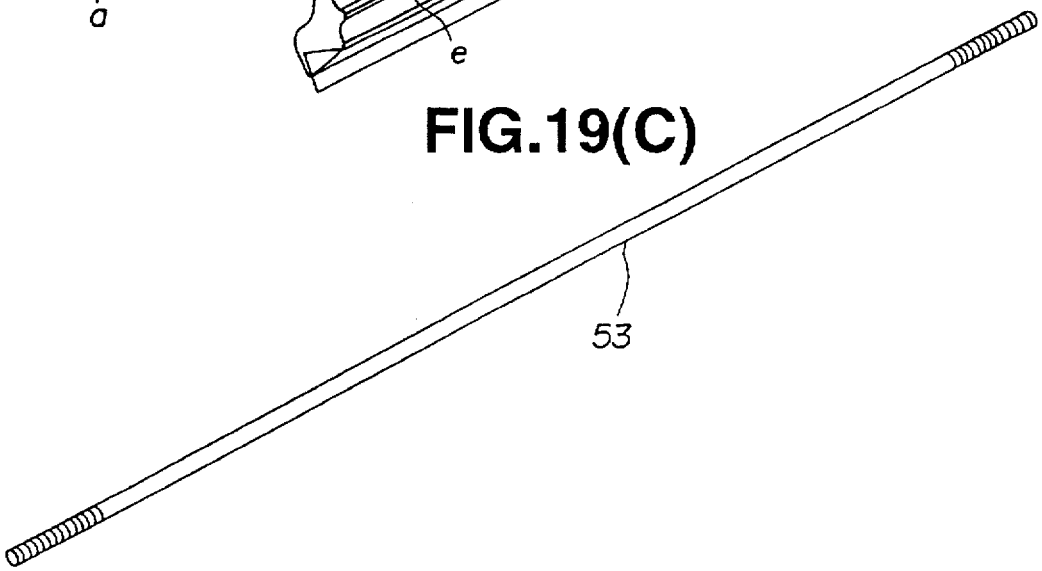

FIG. 18 shows additional structure of the control mechanism of FIG. 15 and FIG. 19(A)–19(C) show a squeegee contol portion including support bar f, with blade fulcrum portion b, replacement bolt portion c, blade setting portion d for the squeegee blade 524. A blade support portion shown in FIG. 19(B) is supported by a fulcrum fitting portion d and end bars g, g at each side thereof are supported by an outside plate or wall portion. The squeegee blade 524 is connected to the blade setting portion a of the driving shaft 514 by a connector, bolt, or the like and driving to the front or rear of the traveling direction to form a printing material supply port to stop the supply or return of printing material. Further, temperature adjusting means, chamber sealing means, adeoxidizer arrangement and an inert gas supply means may also be preferrably provided.

The the control mechanism of the invention performs printing while moving horizontally to the printing surface by being combined with the suspension portion 55 connecting with the printing driving portion according to the structure as set forth above. After printing operation is complete, the control mechanism may be raised and returned to a printing start position. Such operation may be continuously repeated to effect reliable continuous printing operation.

The squeegee 524 within the width of the blade 523 controlled by the inside plate 522, wall blade 525, fixed blade 526 are replacable according to a desired printing width and may be easily formed so as to be interchangeable within the disclosed apparatus.

Further, FIG. 19(A) shows another embodiment of a variable agitation portion 28 including an agitation replacement poriton a, a bar setscrew portion b, a suspension portion c for mounting the replacement portion a and an agitation driving bar d. A driving portion 29 is associated with the support bar f which is pivotally mounted to alternately move to left and right for carrying out agitation of the printing material.

Referring now to FIGS. 20–24, a further embodiment of the agitation and printing material supply means according to the invnetion will be explained hereinbelow.

Figure 20:
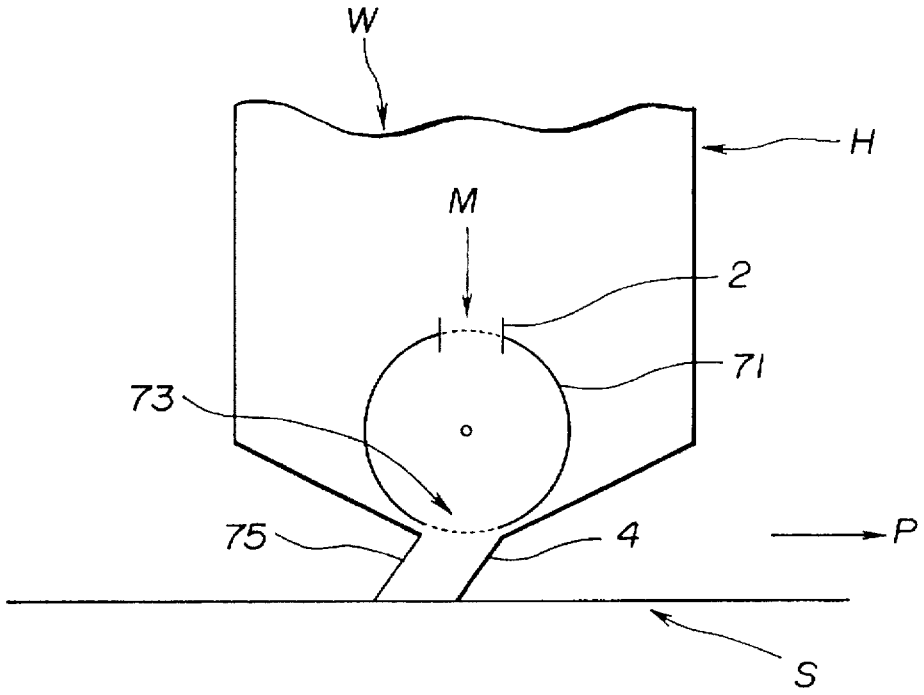
FIG. 20 is a side cross-sectional view of a further embodiment of a agitating portion according to the invention.

Referring to FIG. 20, the agitation means for the enclosed squeegee structure according to the invention may also be formed as a compact cylindrical unit 71 having a printing material inlet side walls 2 defining a material inlet opening M. A lower outlet port 73 is formed for providing the printing material to a printing portion, such as squeegee blades 4, 75, in a controlled manner so as to effect circuit printing in a printing direction P via a screen plate S. The cylindrical printing material chamber 71 is mounted in a housing H such as the outer wall 51 of a control mechanism portion such as described hereinabove.

Figure 21:
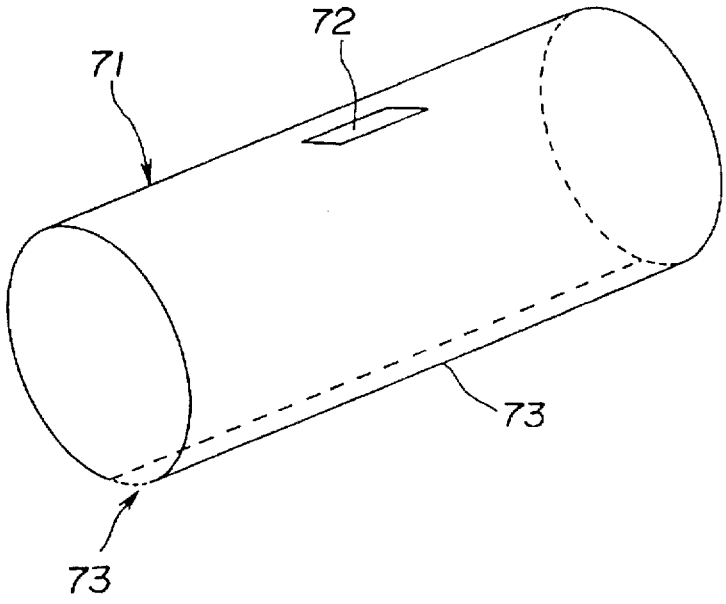
FIG. 21 is aperspective view of the printing material chamber structure of FIG. 20.

FIG. 21 shows a perspective view of the agitation means of the present embodiment.

Further, the stucture of the invention may selectively supply printing material to a plurality of different squeegee blade portions to effect variable width, or variable thickness screen printing. Also, temperature control means and printing material agitating means for maintaining a desired viscosity of printing material are provided.

Paired squeegee blades are rotatably driven in a direction corresponding to a printing direction to oppose a contact surface of a screen plate with controlled amounts of printing material being supplied thereto for effecting clean and accurate printing with simple structure. A blade thickness may be selected to be approximately 0.1 mm to 0.2 mm for a fine print blade and approximately 1 mm to 3 mm for a thick print blade thereof.

Figure 22A:
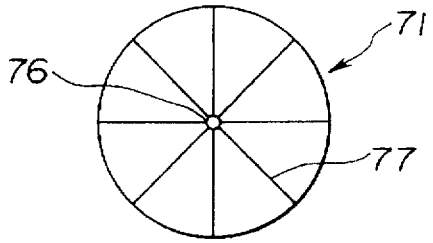
FIG. 22 (A) and (B) are side and lateral views respectively showing the structure and arrangment of agitiation members according to a further embodiment of the invention.
Figure 22B:
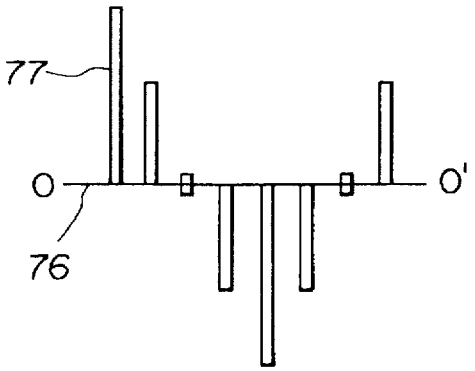

FIGS. 22(A) and 22(B) show lateral and cross sectional views of an internal structure of the agitiation means according to the present embodiment. Agitation members 77 having respectively different lengths are rotatably disposed around a common axial shaft 76.

Figure 23A:
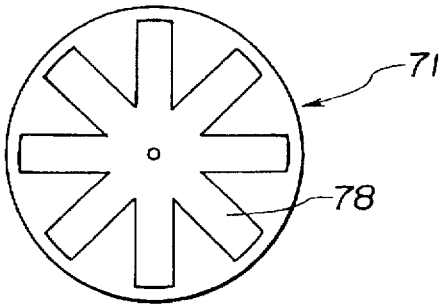
FIGS. 23 (A) and (B) are side and lateral views respectively showing the structure and arrangment of agitiation members according to a still further modification of the preferred embodiment.
Figure 23B:
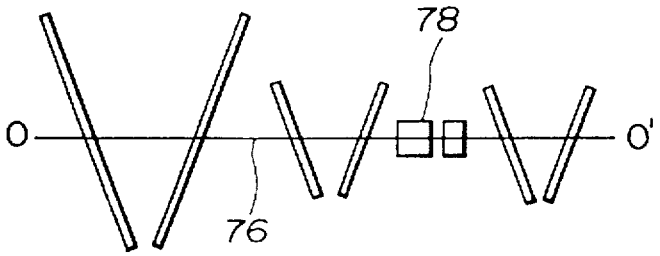

Alternatively, FIGS. 23(A) and 23(B) show lateral and cross sectional views of an internal structure of the agitiation means according to another modification of the present embodiment. Agitation members 78 having respectively different lengths and angular dispositions may be rotatably disposed around a common axial shaft 76.

Internal gears 3-1, 3-2, 4-1,4-2 of a mechanism such as shown in FIGS. 1–2 may further be utilized to transmit rotational driving force to the cylindrical rotation members 1, 2. Rotational gears 5-1, 5-2 are connected with identical side plate members 6L, 6R for controlling coaxial rotation of same. A gear shaft 7 receives rotational energy from the driving source Mc such as an electric motor for example, and transmit the driving force to the rotational gears 5-1, 5-2. Further, additional left and right driving souces MR ML are provided for independently providing driving force to the internal gears 3-1, 3-2, 4-1, 4-2.

Figure 24A:
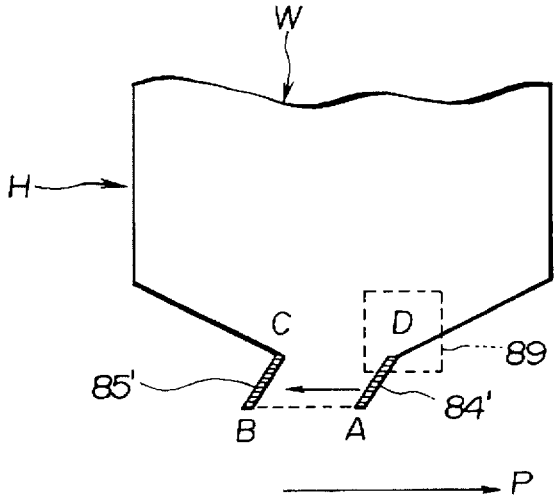
FIGS. 24 (A), 24 (B) and 24 (C) collectively respesent an exploded perpsective view of a control bar and agitation member mounting structure for the control mechanism of FIGS. 15 and 18.
Figure 24B:
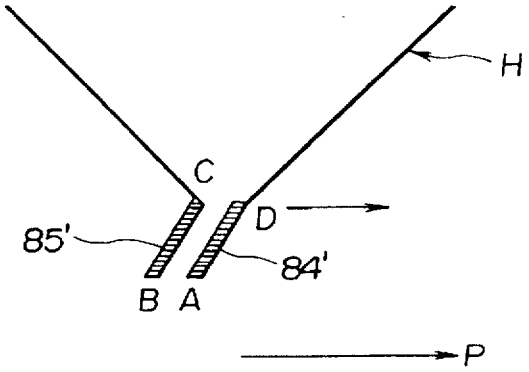
Figure 24C:
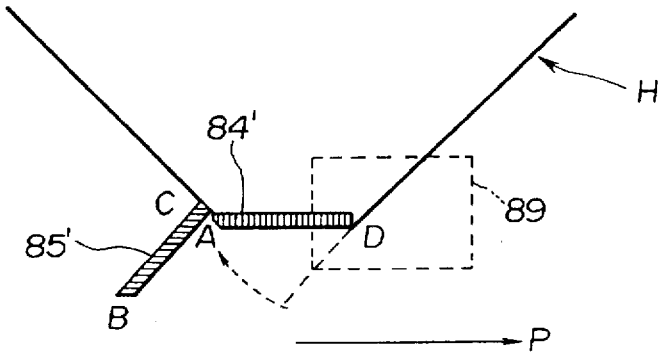

FIGS. 24(A), (B) and (C) show cross sectional side views of alternative embodiments of an enclosed squeegee screen printing unit according to the invention. In this modification, a paired blade arrangment wherein each squeegee blade 84', 85' is disposed at a predetermined angular position to contact a printing surface of a screen plate and moved in a printing direction P according to printing operation. The blades 84', 85', are supplied with printing material and the front blade 84' is horizontally movable relative to the rear blade to control a distance between the squeegees 84', 85' via driving means 89. Referring to FIG. 24(B), an upper side C of the blade 85' is angled wheras the upper side D of the movable blade 84' is flat. It will further be noted that, according to the squeegee control method of the present embodiment, the squeegees 84', 85' may be moved substantially widely apart and the movable blade 84' may be driven via the drive means 89 to assume a horizontal positon so as to block supply of the printing material. Thus replenishing of the printing material may be accomplished without shut down of the apparatus or need for removing or changing of the squeegees.

Further, according to the printing arrangement as set forth above, it is possible to charge a printing material to the squeegees for printing directly on a print surface without need of an intervening screen plate since control of a charged amount of printing material can be precisely controlled.

Thus, according to the present invention as described herein above, there is provided a multi-blade squeegee arrangment for screen printing which may facilitating various types of printing operation with simple structure and high reliablility.

Further, according to the structure of the invention as herein set forth, suitable processing of a printing material utilized for circuit printing or the like is provided.

It will be noted that, although the preferred embodiment is set forth in terms of a screen printing arrangement for circuit printing, the present invention may be embodied in various different ways without departing from the principle of the invention as herein set forth.

The present invention in not limited only to the description as herein disclosed but may be modified and embodied in other ways without departing from the scope or inventive concept of the invention as set forth above.

What is claimed is:

1. A paired-blade squeegee arrangement for an enclosed squeegee type screen printing device for printed circuits, comprising:

a housing having an outlet means from which printing material may be disposed outside of said housing;

a printing material supplying chamber disposed within said housing;

a replaceable paired-blade squeegee arrangement having a predetermined width and being disposed within said housing and communicated with said outlet means of said housing;

squeegee control means for movably controlling said replaceable paired-blade squeegee arrangement; and retaining means for detachably mounting and retaining said replaceable paired-blade squeegee arrangement to said outlet means of said housing, wherein said retaining means has an adjustable width for accommodating said replaceable paired-blade squeegee arrangement having said predetermined width, wherein printing material is provided to the outside of said housing through said replaceable paired-blade squeegee arrangement, and wherein said paired-blade squeegee arrangement comprises;

a first set of front and rear blades disposed foremost in a predetermined printing direction;

a second set of front and rear blades disposed behind said first set of front and rear blades relative to said predetermined printing direction and aligned substantially in parallel therewith;

moving means for moving said first and second sets of front blades and rear blades;

wherein said first and second sets of front and rear blades are independently vertically movable by said moving means for adjusting a printing pressure and wherein said first set of front and rear blades is angled toward a printing direction in a forward position relative to the printing direction, and said second set of front and rear blades is angled away from said printing direction in a rearward position relative to the printing direction, and wherein said outlet means comprises first and second slit portions each communicated respectively with said first and second set of front and rear blades.

2. A paired blade squeegee arrangement for an enclosed squeegee type screen printing device for printed circuits as set forth in claim 1, wherein one of said first and second set of front and rear blades is sharply pointed and formed of a rigid material with a thickness of between 0.1 mm and 0.2 mm.

3. A paired blade squeegee arrangement for an enclosed squeegee type screen printing device for printed circuits as set forth in claim 1, wherein one of said first and second set of front and rear blades is movable relative to the other one thereof on a horizontal plane towards and away from said other one of said blades.

4. A paired blade squeegee arrangement for an enclosed squeegee type screen printing device for printed circuits as set forth in claim 3, wherein said movable one of said first and second set of front and rear blades is further controllable to pivot along an upper edge thereof such that said movable set of blades may be positionally arranged at varying positions from a position perpendicular to a printing surface to a position parallel to and above said printing surface.

5. A paired blade squeegee arrangement for an enclosed squeegee type screen printing device for printed circuits as set forth in claim 4, wherein when said movable one of said first and second set of front and rear blades is in said parallel to and above position relative to said printing surface, said movable set of blades are active to close said printing material outlet.

6. A paired blade squeegee arrangement for an enclosed squeegee type screen printing device for printed circuits as set forth in claim 4, wherein said first and second set of front and rear blades are active to print directly on a printing surface according to controlled charging of printing material from said outlet means.

7. A paired blade squeegee arrangement for an enclosed squeegee type screen printing device for printed circuits as set forth in claim 1, wherein said squeegee first and second set of front and rear blades are retained in a variable width structure, said blades being interchangeable with other squeegee blades having varying widths.

* * * * *